US011358685B1

(12) United States Patent
Lucas

(10) Patent No.: US 11,358,685 B1
(45) Date of Patent: Jun. 14, 2022

(54) MODULAR CATAMARAN

(71) Applicant: Randy Lucas, Spanaway, WA (US)

(72) Inventor: Randy Lucas, Spanaway, WA (US)

( * ) Notice: Subject to any disclaimer, the term of this patent is extended or adjusted under 35 U.S.C. 154(b) by 0 days.

(21) Appl. No.: 17/580,614

(22) Filed: Jan. 20, 2022

(51) Int. Cl.

| | |
|---|---|
| ***B63B 35/34*** | (2006.01) |
| ***B63H 20/02*** | (2006.01) |
| ***B63B 5/24*** | (2006.01) |
| ***B63B 1/12*** | (2006.01) |
| ***B63B 7/04*** | (2020.01) |
| ***B63B 35/38*** | (2006.01) |

(52) U.S. Cl.
CPC ..... *B63B 35/34* (2013.01); *B63B 1/121* (2013.01); *B63B 5/24* (2013.01); *B63B 7/04* (2013.01); *B63B 35/38* (2013.01); *B63H 20/02* (2013.01)

(58) Field of Classification Search
CPC ..... B63B 1/12; B63B 1/121; B63B 2001/123; B63B 2003/085; B63B 7/00; B63B 2007/003; B63B 2007/006; B63B 7/02; B63B 7/04; B63B 34/10; B63B 34/23; B63B 35/34; B63B 35/36; B63B 35/38; B63B 5/24; B63H 20/02
See application file for complete search history.

(56) References Cited

U.S. PATENT DOCUMENTS

| | | | | | |
|---|---|---|---|---|---|
| 2,775,218 | A * | 12/1956 | Kapusnyk | B63B 1/121 | 114/61.24 |
| 4,295,236 | A * | 10/1981 | Upchurch | B63B 34/05 | 114/61.24 |
| 4,315,475 | A * | 2/1982 | Echols | B63B 34/10 | 441/130 |
| 4,854,257 | A * | 8/1989 | Grayson | B63B 27/14 | 114/61.24 |
| 5,086,721 | A * | 2/1992 | Burkard | B63B 1/121 | 114/61.15 |
| 6,135,048 | A | 10/2000 | Emrich | | |
| 6,345,582 | B1 * | 2/2002 | Dudink | B63B 34/05 | 114/61.15 |
| 6,564,735 | B1 | 5/2003 | Jackson | | |
| D520,935 | S | 5/2006 | Schoell | | |
| 7,240,634 | B1 | 7/2007 | Hoge, Jr. | | |
| 7,536,966 | B2 * | 5/2009 | Stryjewski | B63B 35/34 | 114/61.1 |
| 7,587,986 | B2 | 9/2009 | Neidert et al. | | |
| 8,132,523 | B2 * | 3/2012 | White, Jr. | B63B 7/04 | 114/61.24 |
| 9,409,627 | B2 | 8/2016 | Fulop et al. | | |
| 9,776,686 | B2 | 10/2017 | Sizemore | | |
| 9,862,464 | B2 | 1/2018 | Schmidt | | |
| 2003/0121463 | A1 | 7/2003 | Rice | | |

FOREIGN PATENT DOCUMENTS

| | | | |
|---|---|---|---|
| EP | 3725666 | A1 * | 10/2020 |

* cited by examiner

*Primary Examiner* — Ajay Vasudeva
(74) *Attorney, Agent, or Firm* — Cramer Patent & Design, PLLC; Aaron R. Cramer

(57) ABSTRACT

A modular catamaran is a small body catamaran capable of being easily disassembled. The catamaran has approximate dimensions of ten feet-four inches (10'-4") long and ninety-five and a half inches (95½") wide having a pair of foam filled fiberglass pontoons. The top of the catamaran is fabricated with a welded aluminum frame that may be provided complete with seats and an engine.

20 Claims, 5 Drawing Sheets

MODULAR CATAMARAN

RELATED APPLICATIONS

Non-applicable.

FIELD OF THE INVENTION

The present invention generally relates to catamaran and more specifically to a catamaran that is modular.

BACKGROUND OF THE INVENTION

One of favorite type of boats for basic general boating is that of the pontoon boat. They have many benefits especially when large amounts of people are involved. They have plenty of room for entire families and friends. They also have a large amount of storage space for things like ice chests, food, towels, tackle, personal bags, and the like. They are easily to pilot, have a relatively low draft for shallow locations, and are almost impossible to tip over as people move or walk around.

However, pontoon boats suffer from the fact that they are somewhat difficult to move about as well as store. Those who pull a trailer as part of a recreational vehicle (RV) find that pulling another trailer is impossible or even illegal. Accordingly, there exists a need for a means by which the features of a pontoon boat can be enjoyed but without the difficulties of current transport methods. The development of the modular catamaran fulfills this need.

SUMMARY OF THE INVENTION

The disadvantages of the prior art are overcome by the present invention in providing a modular pontoon boat having a habitable platform sitting atop a pair of pontoon assemblies in a parallel manner. The habitable platform includes a walking surface that sits atop an upper frame. The modular pontoon boat also has a forward seat assembly disposed on the habitable platform, an aft seat assembly disposed on the habitable platform for operating the outboard engine, an outboard engine attached behind the habitable platform to provide propulsion for the modular pontoon boat, a set of four angled supports connecting the habitable platform to the pair of pontoon assemblies, a first gusset plate having structural reinforcement between the angled support and a mounting plate, a seat base mounting bracket having a lower plate with a plurality of spacing plates oriented in a perimeter location, and a second gusset plates disposed on before and after each of the angled support to increase structural stability. The second gusset plates are permanently fastened between the angled support and the mounting plate. The lower plate incudes a locking plate disposed on top of the lower plate.

The walking surface may be held in place atop the upper frame via friction fit and may be removable to facilitate storage and transport. Each of the angled supports may terminate at the mounting plate. The angled supports may be disposed on both exterior ends of the habitable platform. The mounting plate sits atop a pontoon frame which may be attached to a pontoon float. The pontoon float may be made of foam-filled fiberglass. The forward face of the pontoon float may have "V"-shaped bow to facilitate movement of the modular pontoon boat through water. The mounting plate may be disposed on top the pontoon frame that may be located along a portion of the pontoon float. A portion of the pontoon float above the shaped bow may not be provided with the pontoon frame. The upper frame may be made of aluminum for its lightweight strength and corrosion resistance in a maritime environment.

The angled supports may be made of aluminum for its lightweight strength and corrosion resistance in a maritime environment. The mounting plate may be made of aluminum for its lightweight strength and corrosion resistance in a maritime environment. The first gusset plates may be made of aluminum for its lightweight strength and corrosion resistance in a maritime environment. The modular pontoon boat may also comprise a pair of removable casters facilitate movement of the modular pontoon boat when it is out of the water.

The locking plate may be disposed on top of the lower plate produces a slot that a bottom surface of a swivel plate is slid into. The swivel plate may include a locking means that allows for the forward seat assembly and the aft seat assembly to swivel about for comfort and ease of viewing. The locking means may be selected from the group consisting of a pin, a bolt, or a bar. A top surface of the swivel plate may then connect to a chair base disposed on the forward seat assembly and the aft seat assembly. The seat base mounting bracket may allow for removal of the forward seat assembly and the aft seat assembly when the modular pontoon boat required disassembly for storage or transport. The mounting plate may be mechanically connected to the pontoon frame via a plurality of fasteners to allow for easy field separation of the mounting plate from the pontoon frame to facilitate storage and transport.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
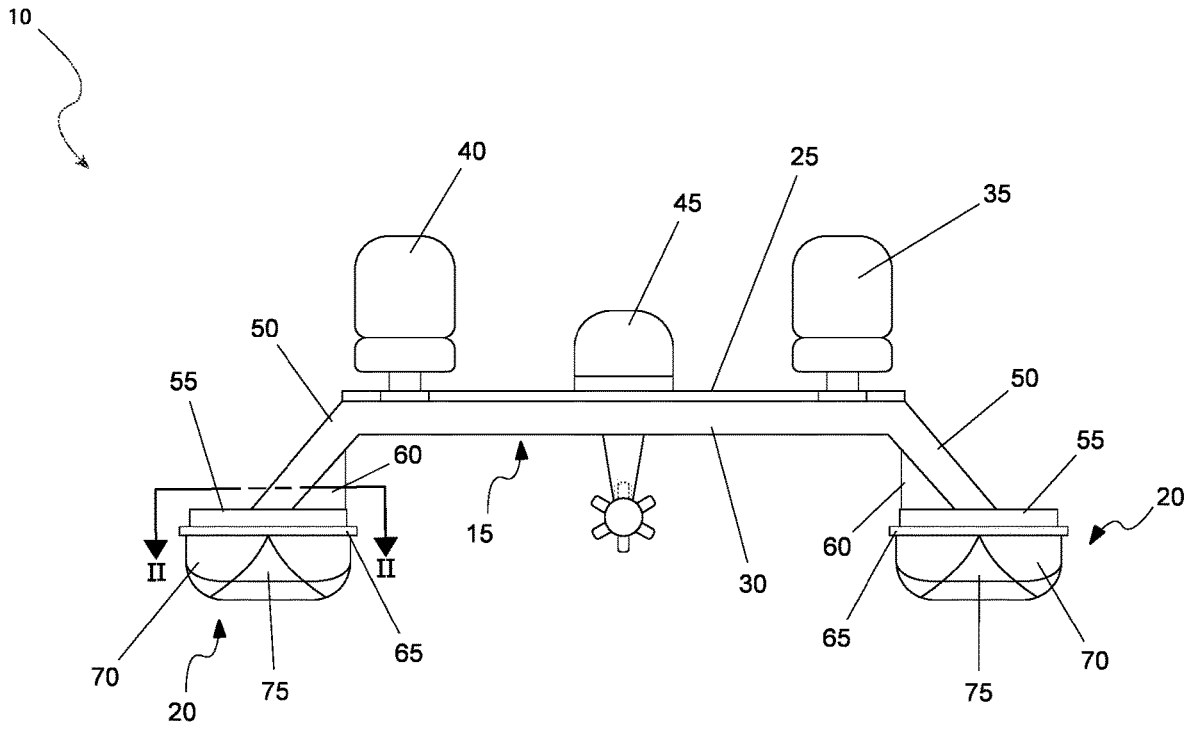
FIG. 1 is a front view of the modular pontoon boat, according to the preferred embodiment of the present invention.

10 modular pontoon boat
15 habitable platform
20 pontoon assembly
25 walking surface
30 upper frame
35 forward seat assembly
40 aft seat assembly
45 outboard engine
50 angled support
55 mounting plate
60 first gusset plate
65 pontoon frame

70 pontoon float
75 bow
80 clear space
82 removable caster
85 seat base mounting bracket
90 lower plate
95 spacing plate
100 locking plate
105 slot
110 bottom surface
115 swivel plate
120 top surface
125 chair base
130 bearing
135 locking means
140 fastener
145 weldment
150 second gusset plate
155 continuous hinge
160 structural reinforcing member
165 forward seat cutout
170 aft seat cutout

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front view of the modular pontoon boat 10, according to the preferred embodiment of the present invention is disclosed. The modular pontoon boat (herein also described as the "boat") 10, comprises a small body catamaran, similar to a pontoon boat, which is easily disassembled for transport without the need for a specialized trailer. The invention provides for a habitable platform 15 that sits atop two (2) pontoon assemblies 20. The pontoon assemblies 20 are provided in a parallel manner as would be normally expected. The habitable platform 15 is provided with a walking surface 25 that sits atop an upper frame 30. A forward seat assembly 35 and an aft seat assembly 40 is provided on the habitable platform 15. An outboard engine 45, conventional in design, may be attached to the rear of the habitable platform 15 to provide propulsion for the boat 10. A set of four (4) angled supports 50 (of which only two (2) are shown due to illustrative limitations) connect the habitable platform 15 to the two (2) pontoon assemblies 20. Each angled support 50 terminates at a mounting plate 55 which will be described in greater detail herein below. A first gusset plate 60 provides structural reinforcement between the angled support 50 and the mounting plate 55. The mounting plate 55 sits atop a pontoon frame 65 which is in turn attached to a pontoon float 70. The pontoon float 70 is envisioned to be made of foam-filled fiberglass. Other materials such as entirely made of foam, plastic, steel, or the like may also be utilized. As such, the use of any specific type of pontoon float 70 is not intended to be a limiting factor of the present invention. The forward face of the pontoon float 70 is envisioned to be provided with a "V"-shaped bow 75 to facilitate movement of the boat 10 through water.

Figure 2:
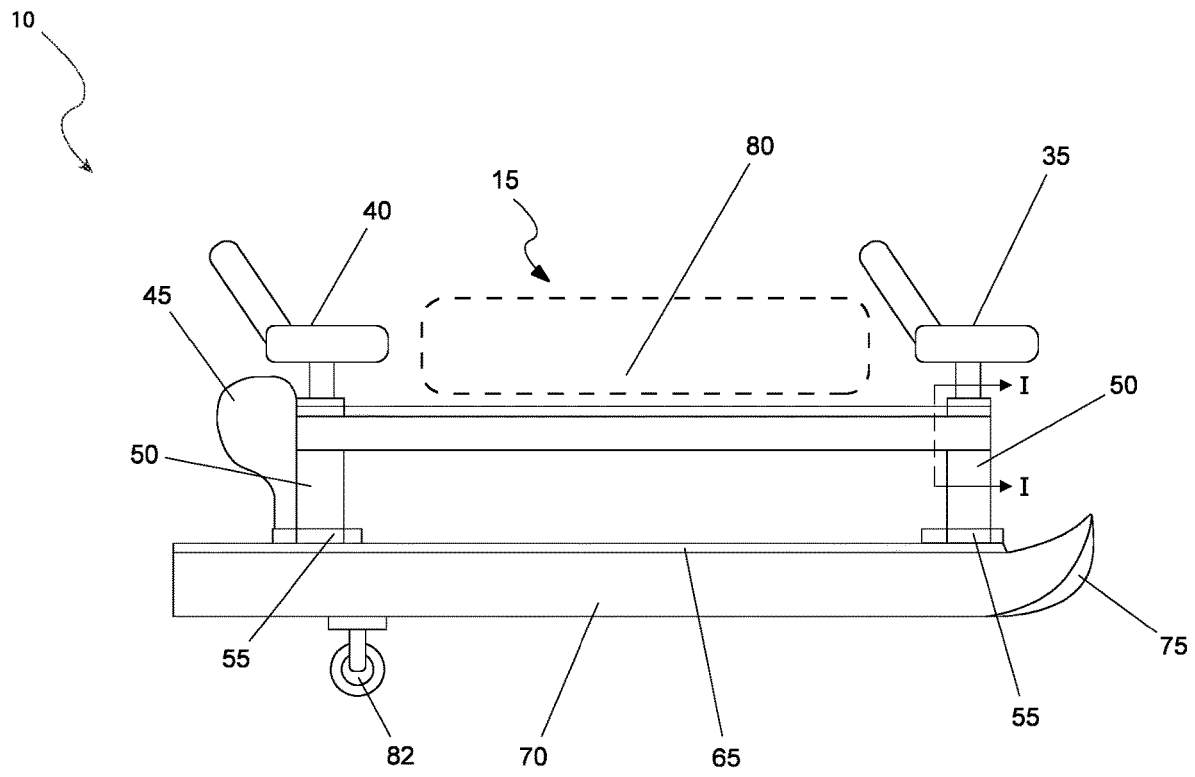
FIG. 2 is a side view of the modular pontoon boat, according to the preferred embodiment of the present invention.

Referring next to FIG. 2, a side view of the boat 10, according to the preferred embodiment of the present invention is depicted. This view clearly depicts the placement relationship of the forward seat assembly 35 and the aft seat assembly 40 to the outboard engine 45. The aft seat assembly 40 is likely used for operation of the outboard engine 45. This arrangement leaves clear space 80 on the habitable platform 15 for other purposes such as supplies, passengers, swimming aids, and the like. A typical size of the boat 10 is envisioned to be approximately ten feet-four inches (10 ft.-4 in.) long and ninety-five and one-half inches (95½ in.) wide. Other sizes, both smaller and larger, may also be produced. As such, any specific dimension of the boat 10 is not intended to be a limiting factor of the present invention. The angled supports 50 are located at the exterior ends (forward and aft) of the habitable platform 15. The mounting plate 55 is located atop the pontoon frame 65 with is only located along a portion of the pontoon float 70. The portion of the pontoon float 70 above the shaped bow 75 is not provided with a pontoon frame 65 as it is not necessary. It is envisioned that all major structural components of the boat 10 including the upper frame 30, the angled supports 50, the mounting plate 55 and the first gusset plates 60 would be made of aluminum for its lightweight strength and corrosion resistance in a maritime environment. A set of two (2) removable casters 82 (one (1) per each pontoon assemblies 20) are provided to facilitate movement of the boat 10 when it is out of the water.

Figure 3:
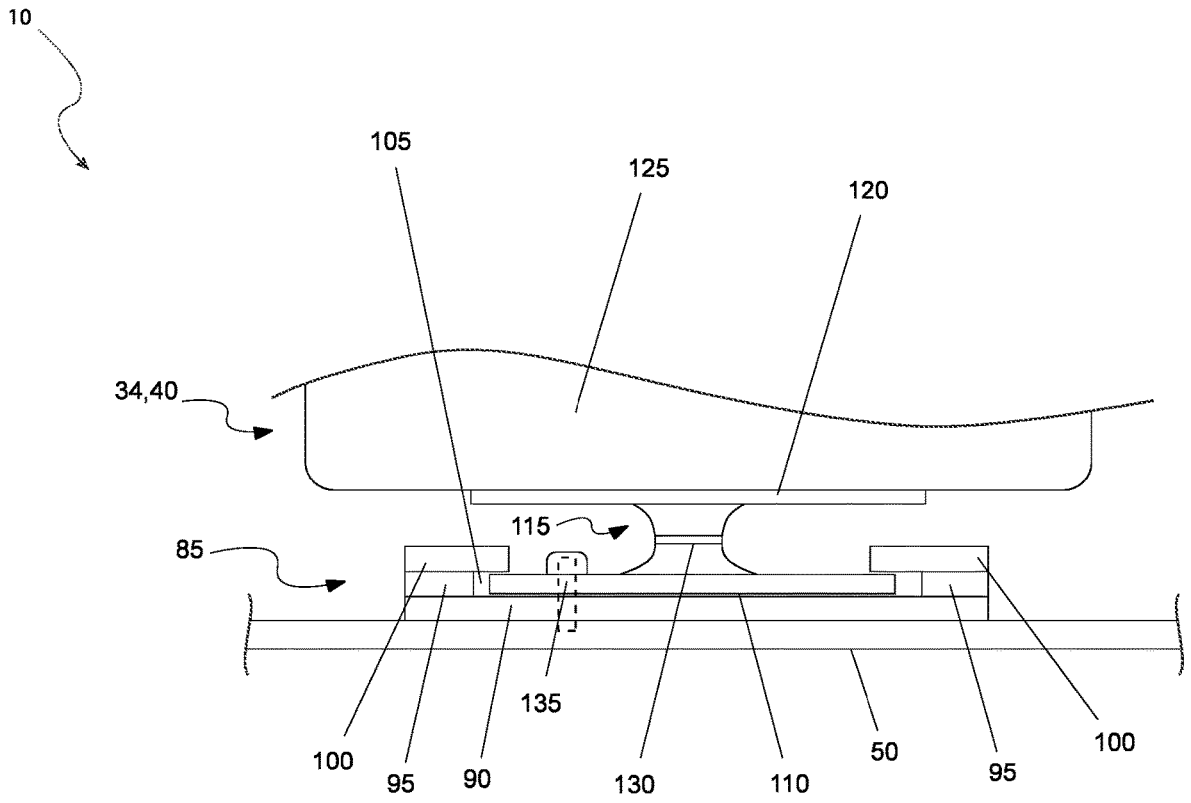
FIG. 3 is a sectional view of the modular pontoon boat, as seen along a Line I-I, as shown in FIG. 2, according to the preferred embodiment of the present invention.

Referring now to FIG. 3, a sectional view of the boat 10, as seen along a Line I-I, as shown in FIG. 2, according to the preferred embodiment of the present invention is shown. The figure depicts a seat base mounting bracket 85, each having a lower plate 90, with spacing plates 95 above in a perimeter location, followed by a locking plate 100 on top. This configuration produces a slot 105 upon which a bottom surface 110 of a swivel plate 115 may be slid into. A top surface 120 then connects to a chair base 125 as provided on the forward seat assembly 35 and the aft seat assembly 40, both of which are shown in FIG. 1 and FIG. 2. The swivel plate 115 is provided with a locking means 135 that allows for the forward seat assembly 35 and the aft seat assembly 40 to swivel about for comfort and ease of viewing. A locking means 135 such as a pin, bolt, bar, or the like, is provided to keep the bottom surface 110 from exiting the slot 105 until desired. The seat base mounting bracket 85 allows for removal of the forward seat assembly 35 and the aft seat assembly 40 in a manner of seconds each, should the boat 10 required disassembly for storage and/or transport.

Figure 4:
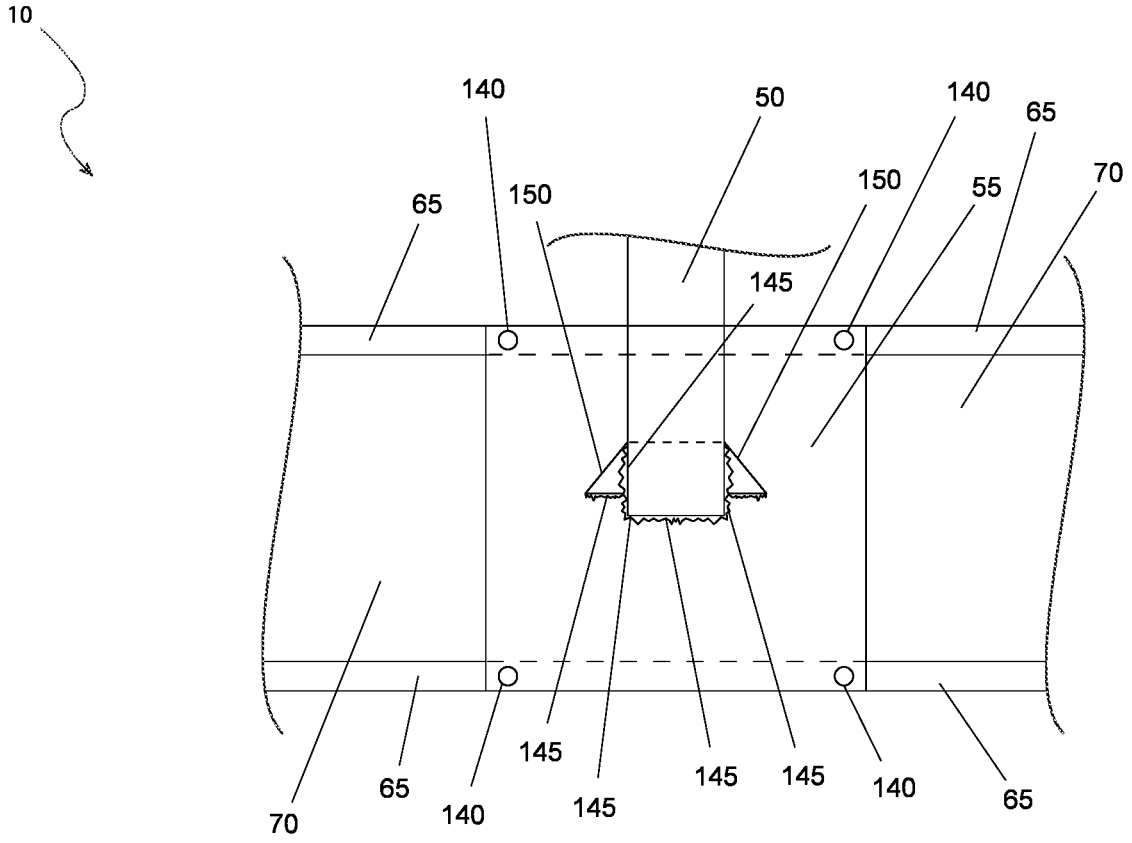
FIG. 4 is a sectional view of the modular pontoon boat, as seen along a Line II-II, as shown in FIG. 1, according to the preferred embodiment of the present invention.

Referring next to FIG. 4, a sectional view of the boat 10, as seen along a Line II-II, as shown in FIG. 1, according to the preferred embodiment of the present invention is disclosed. This view depicts the pontoon float 70 with the pontoon frame 65 located at the long sides. The mounting plate 55 is mechanically connected to the pontoon frame 65 via at least four (4) fasteners 140 such as bolts. The fasteners 140 allow for easy field separation of the mounting plate 55 from the pontoon frame 65 to facilitate storage and transport. The angled support 50 is attached in a permanent manner to the mounting plate 55 via weldment 145. At least two (2) second gusset plates 150 are provided fore and aft of each angled support 50 to increase structural stability. The second gusset plates 150 are permanently fastened between the angled support 50 and the mounting plate 55 via weldment 145.

Figure 5:
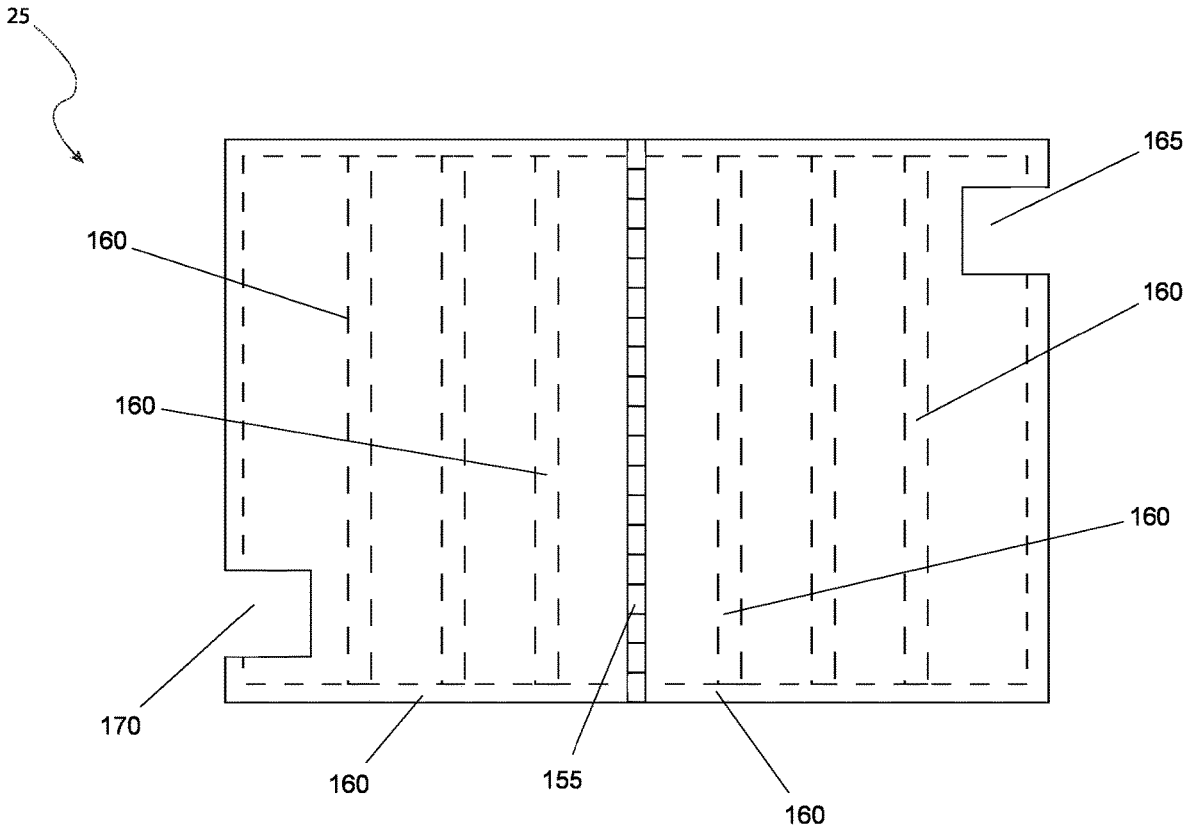
FIG. 5 is a top view of the walking surface, as used with the modular pontoon boat, according to the preferred embodiment of the present invention.

Referring to FIG. 5, a top view of the walking surface 25, as used with the boat 10, according to the preferred embodiment of the present invention is depicted. The walking surface 25 is held in place atop the upper frame 30 via friction fit and is easily removable to facilitate storage and transport. It is foldable at its midpoint via a continuous hinge 155 such as a piano hinge. The walking surface 25 is provided with structural reinforcing members 160 on its underside (hence shown in a hidden state via dashed lines). The walking surface 25 is provided with a forward seat cutout 165 and an aft seat cutout 170 for the seat base mounting bracket 85 (as shown in FIG. 3) for the forward seat assembly 35 and the aft seat assembly 40 (both of which are shown in FIG. 1) respectively.

2. Operation of the Preferred Embodiment

The preferred embodiment of the present invention can be utilized by the common user in a simple and effortless manner with little or no training. It is envisioned that the boat 10 would be constructed in general accordance with FIG. 1 through FIG. 5. The user would procure the boat 10 from conventional procurement channels such as sporting goods stores, recreational vehicle retailers, boating stores, mail order and internet supply houses and the like. Special attention would be paid to the overall desired size of the boat 10 with respect to needs, transport means, and storage location.

After procurement and prior to utilization, the boat 10 would be prepared in the following manner: prior to utilization, the boat 10 is provided in separate components or modules as follows: the two (2) pontoon assemblies 20, the upper frame 30 comprising the angled supports 50, the mounting plate 55 and associated minor components, the walking surface 25, the forward seat assembly 35, the aft seat assembly 40, and the outboard engine 45 if so utilized. These components are transported from their storage location, such as a garage or shed to utilization location via a wide variety of transportation means. The transportation means is envisioned to include but not limited to a pickup truck, a utility trailer, atop a motor vehicle, inside of a recreational vehicle such as a "toy hauler" or the like. Upon arrival at the utilization location such a lake or pond, the various components are ready to be assembled.

During assembly of the modular pontoon boat 10, the following procedure would be initiated: the pontoon assemblies 20 would be positioned in their general location; the upper frame 30 comprising the angled supports 50, the mounting plate 55 and associated minor components, would be positioned atop the pontoon assemblies 20; the fasteners 140 would mechanically couple the mounting plate 55 to the pontoon frame 65; the walking surface 25 would be set atop the upper frame 30, the forward seat assembly 35 and the aft seat assembly 40 would be positioned in their respective seat base mounting bracket 85; and the outboard engine 45 (if used) would be attached to the rear of the upper frame 30. At this point in time, the boat 10 is ready for utilization.

During utilization of the boat 10, the operator would sit in the aft seat assembly 40 and operated the outboard engine 45 if so utilized. The clear space 80 of the boat 10 is equally usable during anchoring or transit in a normal manner when compared to conventional pontoon boats.

After use of the boat 10, it is disassembled for transport and storage in the following manner; removal of all items and people from the clear space 80, removal of the outboard engine 45 if used, removal of the forward seat assembly 35 and aft seat assembly 40, removal and folding of the walking surface 25, removal of the fasteners 140 form the mounting plate 55, removal of the upper frame 30 comprising the angled supports 50, the mounting plate 55 and associated minor components, from the pontoon assemblies 20. At this point in time the boat 10 may be transported and stored until needed again in a cyclical manner.

The features of the boat 10 are envisioned to provide the following benefits: reduced storage space when disassembled; storage in a small location such as inside of a garage or shed; ability to transport in almost any vehicle; no need for a dedicated pontoon boat trailer; ability to assembly and disassemble with a minimum of hand tools; stability in the water; foam filled pontoons that cannot fill with water and sink; and three-hundred sixty degree (360°) viewing of surrounding areas.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A modular pontoon boat, comprising:

a habitable platform sitting atop a pair of pontoon assemblies in a parallel manner, the habitable platform includes a walking surface that sits atop an upper frame;

a forward seat assembly disposed on the habitable platform;

an aft seat assembly disposed on the habitable platform for operating the outboard engine;

an outboard engine attached behind the habitable platform to provide propulsion for the modular pontoon boat;

a set of four angled supports connecting the habitable platform to the pair of pontoon assemblies;

a first gusset plate having structural reinforcement between the angled support and a mounting plate;

a seat base mounting bracket having a lower plate with a plurality of spacing plates oriented in a perimeter location, the lower plate incudes a locking plate disposed on top of the lower plate; and a second gusset plates disposed on before and after each of the angled support to increase structural stability, the second gusset plates are permanently fastened between the angled support and the mounting plate.

2. The modular pontoon boat, according to claim 1, wherein the walking surface is held in place atop the upper frame via friction fit and is removable to facilitate storage and transport.

3. The modular pontoon boat, according to claim 1, wherein each of the angled supports terminate at the mounting plate.

4. The modular pontoon boat, according to claim 1, wherein the angled supports are disposed on both exterior ends of the habitable platform.

5. The modular pontoon boat, according to claim 1, wherein the mounting plate sits atop a pontoon frame which is attached to a pontoon float.

6. The modular pontoon boat, according to claim 5, wherein the pontoon float is made of foam-filled fiberglass.

7. The modular pontoon boat, according to claim 5, wherein the forward face of the pontoon float has "V"-shaped bow to facilitate movement of the modular pontoon boat through water.

8. The modular pontoon boat, according to claim 5, wherein the mounting plate disposed on top the pontoon frame that is located along a portion of the pontoon float.

9. The modular pontoon boat, according to claim 5, wherein a portion of the pontoon float above the shaped bow is not provided with the pontoon frame.

10. The modular pontoon boat, according to claim 1, wherein the upper frame is made of aluminum for its lightweight strength and corrosion resistance in a maritime environment.

11. The modular pontoon boat, according to claim 1, wherein the angled supports are made of aluminum for its lightweight strength and corrosion resistance in a maritime environment.

12. The modular pontoon boat, according to claim 1, wherein the mounting plate is made of aluminum for its lightweight strength and corrosion resistance in a maritime environment.

13. The modular pontoon boat, according to claim 1, wherein the first gusset plates are made of aluminum for its lightweight strength and corrosion resistance in a maritime environment.

14. The modular pontoon boat, according to claim 1, further comprising a pair of removable casters facilitate movement of the modular pontoon boat when it is out of the water.

15. The modular pontoon boat, according to claim 1, wherein the locking plate disposed on top of the lower plate produces a slot that a bottom surface of a swivel plate is slid into.

16. The modular pontoon boat, according to claim 1, wherein the swivel plate includes a locking means that allows for the forward seat assembly and the aft seat assembly to swivel about for comfort and ease of viewing.

17. The modular pontoon boat, according to claim 16, wherein the locking means is selected from the group consisting of a pin, a bolt, or a bar.

18. The modular pontoon boat, according to claim 1, wherein a top surface of the swivel plate then connects to a chair base disposed on the forward seat assembly and the aft seat assembly.

19. The modular pontoon boat, according to claim 18, wherein the seat base mounting bracket allows for removal of the forward seat assembly and the aft seat assembly when the modular pontoon boat required disassembly for storage or transport.

20. The modular pontoon boat, according to claim 1, wherein the mounting plate is mechanically connected to the pontoon frame via a plurality of fasteners to allow for easy field separation of the mounting plate from the pontoon frame to facilitate storage and transport.

* * * * *